United States Patent [19]

Gilbert

[11] Patent Number: 4,742,211

[45] Date of Patent: May 3, 1988

[54] ELECTRICAL RESISTANCE HEATER

[76] Inventor: John F. Gilbert, Calle Santa Marta 6, Javea Provincia de Alicante, Spain

[21] Appl. No.: 476

[22] Filed: Jan. 5, 1987

[30] Foreign Application Priority Data

Jan. 4, 1986 [GB] United Kingdom ..... 8600139

[51] Int. Cl.[4] ..... H05B 3/44; H05B 3/50

[52] U.S. Cl. ..... 219/544; 219/443; 219/459

[58] Field of Search ..... 219/544, 345, 358, 343, 219/443, 445, 449, 455, 457, 459, 460, 461; 99/446, 445, 444

[56] References Cited

U.S. PATENT DOCUMENTS 1,531,308 3/1925 Rice et al. ..... 219/459
1,614,661 1/1927 Detwiler ..... 99/446
1,659,774 2/1928 Hicks ..... 219/459
2,812,706 11/1957 Francia et al. ..... 219/443
2,856,502 10/1958 Wolf ..... 219/443

FOREIGN PATENT DOCUMENTS 889847 1/1944 France ..... 219/459

*Primary Examiner*—H. Broome
*Attorney, Agent, or Firm*—Oldham, Oldham & Weber Co.

[57] ABSTRACT

An electrical resistance heater comprises a planar structure having a plurality of elements arranged in parallel side-by-side relationship. Each element comprises a casing containing a resistance heating wire which is embedded in a matrix of a material of good thermal conductivity. The casing has an upwardly radiating surface provided with a series of convolutions of which the re-entrant portions communicate with openings extending through the heater.

15 Claims, 2 Drawing Sheets

ELECTRICAL RESISTANCE HEATER

This invention relates to electrical resistance heaters whose heat emission is by radiation and lies principally in the infra-red wave band. In such heaters the heat may radiate directly from the resistance wire to the object to be heated, or alternatively the resistance wire may be in intimate contact with an electrically non-conductive material to which the heat is transferred by conduction, and which in turn radiates the heat to the objective. Such constructions may further be encased in a metal sheath or case.

In cooking operations where the heat is transmitted to the food by radiation, it is advantageous to place the radiant elements in a horizontal arrangement under which the food is located. In order to increase the rate of heat input, a second heater may be placed below the food. In such an arrangement the food can conveniently by introduced into and removed from the cooking zone by horizontal movement and it has been found convenient to bring about that movement by use of a mechanical conveyance such as metallic lattice-work moving belt.

In commercial cooking operations, cooking time is one of the factors governing efficiency, and where process permits, the use of radiant heat sources both above and below the food results in enhanced productivity. In the cooking of some products such as meat in the form of steaks, hamburgers etc, it is a desirable requirement for achieving flavour or texture to cause the fat content of the meat to ignite or "flame" during the cooking process. For that purpose some method of ignition must be provided. Where electrical heating is used it is convenient to bring about ignition by locating heaters below the food. This has the twofold purpose of first heating the meat to a temperature at which the fat melts and drops downwards, and then of igniting the incident fat to provide the required flame. In such arrangements the heater surface temperature must be higher than the flash point of the fat and adequate air must be admitted in order to support the desired degree of fat combustion.

In other meat cooking processes, for example grilling of bacon, significant quantities of fat are released from the food during heating but flaming of this fat is normally undesirable. Nevertheless flaming can occur if a radiant heat source is provided underneath the food, where the heater temperature is above the flash point of the fat.

Existing electrical radiant heaters used in the above applications comprise several types. Of one type are heaters composed of metal sheathed elements in which the resistance wire is contained in a metal sheath of continuous small cross sectional dimension, the resistance wire being coaxial with the metal sheath and insulated electrically therefrom by a non-conductive filling material. Such elements are of minimal mass compatible with robustness, and so are of small surface area. Heat emission, being proportionate to surface area, attains useful levels only if relatively high surface temperatures are attained. In heaters composed of such elements the surface area of the food to be cooked is normally many times the area of the radiant surface of the element sheath, and in order to permit even and simultaneous radiation to the food surface, such heaters are usually constructed so that the sheath element follows a regular serpentine or spiral pathway in one plane, the neighbouring portions of the elements being spaced from one another by an air gap of several times the cross sectional dimension of the sheath. Where such heaters are arranged to cook food from underneath, a significant portion of the total heat output is carried from the elements by the upwards convection movement of air through the gaps in the element. Also much of the heat is radiated downwards away from the food. Where the cooking process releases fat, either the food must be cooked in a fat-collecting tray, which may be undesirable, and such arrangement prohibits direct radiation from the heater to the lower side of the food, or alternatively the fat may be collected underneath the heater but unwanted ignition of fat may take place where fat drops on the elements. Where flaming is required this may be inhibited by the passage of too much air upwards through the heater, so providing unwanted cooling. Furthermore, ignition of incident fat by the heater may be too localised to be effective, due to the small dimensions of the element structure.

Another type of heater used in radiant heating of food comprises a resistance wire contained in a platen of large superficial area. The wire can be arranged so that it follows a regular serpentine or spiral pathway within the platen structure. The platen may be made of any suitable solid material such as metal or ceramic, and where metal is used, electrically non-conductive material is provided to prevent the flow of electrical current to the exposed metal portion of the heater. Such heaters have the advantage that they can, by reason of their large planer surface area, achieve high radiant heat emission relative to surface temperature. However, their use for radiation upwards in the cooking of fatty food products presents the problem that incident fat accumulations on their flat upper radiating surface may become carbonised, impairing the radiation and presenting possibilities of periodic and uncontrolled combustion of the carbonised fat. Where flaming is required, fat combustion may be imperfect or intermittent due to the absence of provision for admitting combustion air.

We are also aware of GB Pat. No. 517 429 which discloses apparatus for grilling food in which several electrical heating tubes are connected together to form an integral unit which is hinged at one end to a sloping tray. A channel collects melted fat which runs down the tray. The tubes have a groove to assist in collecting and draining fat, and may have wings for the same purpose. The heating tubes comprises coils of wire wound on insulators supported within the tubes.

A heater is now proposed in the form of a planar structure having an element comprising a casing containing resistance heating wire and having an upwardly radiating surface provided with a series of regular convolutions of which re-entrant portions communicate with openings extending through the heater, the heating wire being embedded in a matrix of good thermal conductivity.

Preferably the resistance wire is insulated within a metal sheath by finely divided electrically non-conductive material, suitably mineral powder.

This enables us to provide two separate insulation phases. We have realised that the material of the matrix is not as good an electrical insulator as the finely divided mineral material, and that this adverse quality is made worse the higher the operating temperature. However the material of the matrix is a good thermal conductor, and by casting it within a casing ensures good contact both with the metal sheathing of the resistance wire and the metal casing of the element.

Using a metal-sheathed resistance wire enables us to employ only a relatively small dimension for the finely divided material, thus optimising the structure from the point of view of heat transmission from the resistance wire, which then runs at a relatively lower temperature for any given surface emission temperature of the element. This promotes relatively long life for the resistance wire, and also permits continuous operation at a relatively higher temperature, for example at temperatures higher than the melting point of cast aluminium, a common material used in heater platens.

To summarise, our heater provides high operating temperatures, with good electrical insulation combined with reduced temperature differential across the structure of the element.

The convolutions may be in the form of corrugations or convexities or may be pyramidal.

The heater may be composed of a plurality of individual heater elements, each element containing resistance wire and all assembled together to form the heater. In such an assembly, such spacers may be provided between neighbouring elements as will constitute some or all of the perforations extending through the heater. The assembly of the elements to form the heater may be by way of attachment of the elements to one another, or to a framework, or to an adjacent structure, such as an oven framework. Such attachment may be permanent as by welding or may be dismountable as by bolting.

The external surface of the heater may be ceramic or metallic or a combination of the two. The perforations in the heater may be continuous in the form of slots, or may comprise a series of holes.

The pathway followed by the resistance wire may be related to or correspond with the slopes or corrugations in the radiating surface of the heater.

One or more thermocouples or thermocouple pockets may be provided in the heater structure to yield data for control of the heater temperature.

Thermally insulating material may be incorporated in the construction in regions away from the radiating surface, in order to reduce unwanted heat emission.

It has been found that heaters of the type now proposed have the advantage that heat emission is high at surface temperatures below the flash point of fats, thus permitting the rapid cooking of fatty meats by the use of heaters located underneath the food. Incident melted fat is conducted through the perforations to a collection tray beneath. Flaming temperatures are easily attained and controlled over the heater area. The provision of perforations of suitable dimensions and distribution permits the introduction of adequate combustion air, but not in excessive quantities such as would cause cooling. Provision of thermally insulating material away from the corrugated surface reduces wasteful radiation downwards.

Some embodiments of our invention are illustrated in the accompanying drawings in which.

Figure 1:
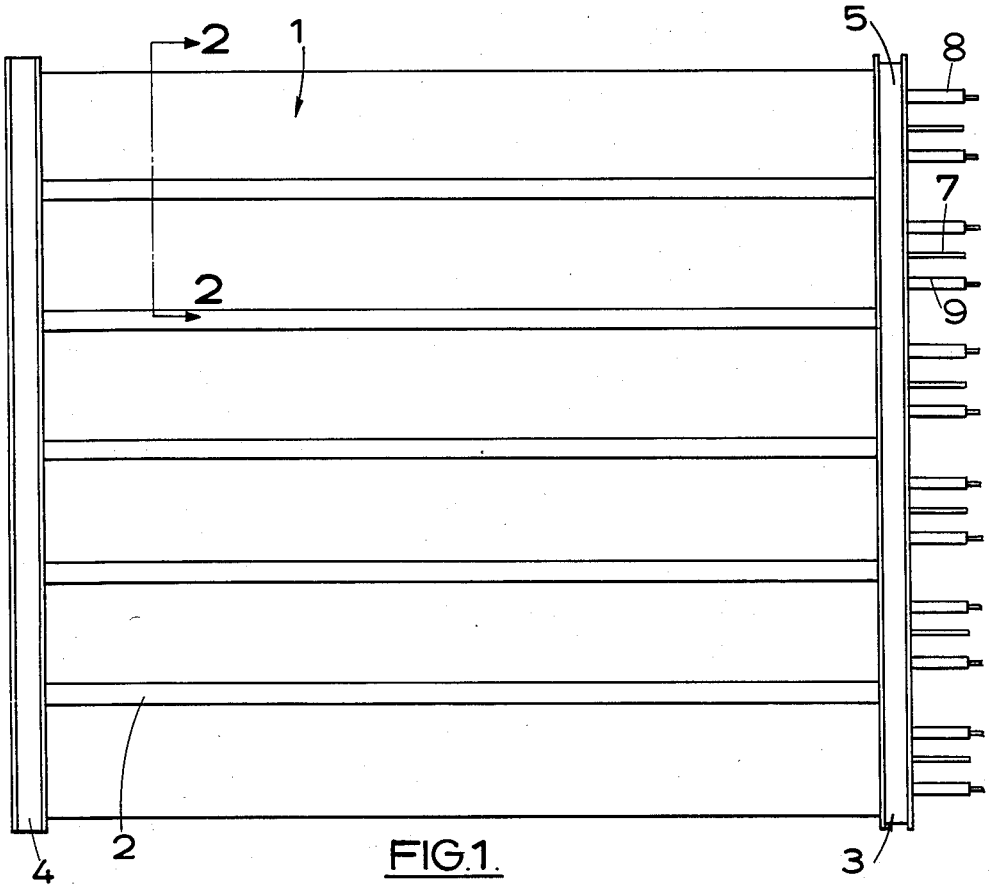
FIG. 1 is a plan of an electrical resistance heater.
Figure 2:
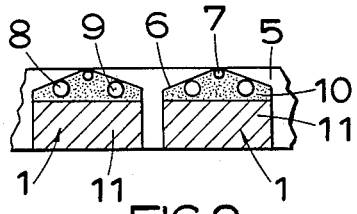
FIG. 2 is a section on the line 2—2 of FIG. 1 through a pair of adjacent heater elements.

The electrical resistance heater illustrated in FIGS. 1 and 2 of the accompanying drawings emits heat by radiation, principally in the infra-red wave band.

The heater comprises a plurality of individual heater elements 1 which are arranged in a side-by-side parallel relationship with edges of adjacent elements spaced from each other to define continuous slots 2 through which melted fat from food being cooked upon the heater can be conducted into a collection tray beneath and through which combustion air can be introduced to facilitate cooking.

The elements 1 are retained in the side-by-side relationship by means of a framework 3 and opposite ends of the elements 1 are received in spaced parallel end plates 4,5 of the framework.

Each element 1 comprises a high temperature corrosion resistant case 6 of alloy or ceramic material or a combination of both. The case has spaced parallel side walls which are upstanding from a planar base wall, and a top wall constituted by portions which are oppositely inclined downwardly from an apex. A thermocouple pocket 7 and a metal sheathed, mineral insulated, resistance wire comprising continuous lengths 8,9 which extend longitudinally of the element are embedded within a matrix 10 of cast mineral cement of good thermal conductivity. The terminals for the two lengths are both at the same end of the heatercast mineral cement. The thermocouple pocket 7 is located adjacent to the apex of the case 6, with the lengths 8 and 9 spaced from opposite sides of it. The remaining area of the case 6, defined between the base wall and a substantial part of each side wall, is filled with a filler of glass fibre or glass wool insulation 11.

Figure 3:
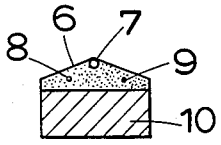
FIG. 3 is a section through a heater element similar to those shown in FIG. 2 but showing a modification.

In the element shown in FIG. 3 the sheathing for the resistance wire 8, 9 is omitted.

Figure 4:
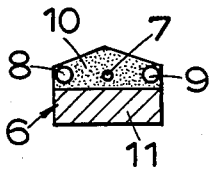
FIGS. 4–10 are sections through different heater elements.

In the element shown in FIG. 4 the sheathed resistance wire 8, 9 is positioned closer to the side walls of the case 6, and the thermocouple pocket 7 is adjacent to the base of the matrix 10.

Figure 5:
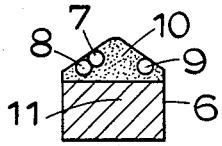

In the element shown in FIG. 5, the thermocouple pocket 7 is placed in close proximity to the resistance wire length 8 and, when the wire is sheathed, the pocket 7 is in contact with the sheathing. This enables finer control to be attained. In addition the thermocouple itself is placed in close proximity to the outer case 6. This enables the thermocouple to monitor, more closely, the surface temperature emission of the element and signal that to a temperature controller.

Figure 6:
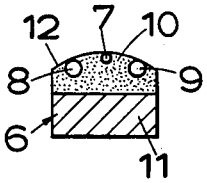

In the element shown in FIG. 6 the top wall of the case 6 is of arcuate outline as shown at 12.

Figure 7:
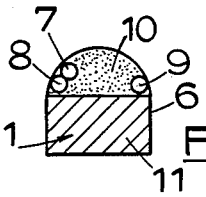

In the element shown in FIG. 7, which is similar to that of FIG. 6, the pocket 7 is again in contact with the sheathing, and is in close proximity to the casing 6.

Figure 8:
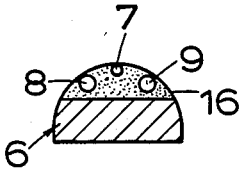

In the element of FIG. 8 the side walls and the top wall of the case 6 are defined by a skin 16 substantially of semi-circular outline.

Figure 9:
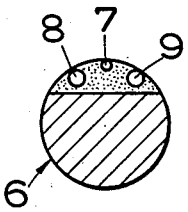

Finally, in the element of FIG. 9, the case 6 is of circular outline.

Figure 10:
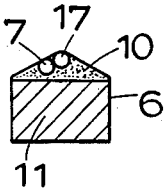

In the elements shown in FIGS. 2–9, the resistance wire 8, 9 is of continuous "hairpin" or "U" shaped configuration. In the element of FIG. 10 the resistance wire comprises a single length 17 and the terminals for its opposite ends are disposed at opposite ends of the heater. In this element the wire 17 is disposed close to the apex of the casing in close proximity to the thermocouple pocket 7.

In all the elements described above a thermocouple is installed in a pocket 7. In a modification the pocket 7 is omitted and the thermocouple, itself, is embedded in the cast mineral cement 10.

Figure 11:
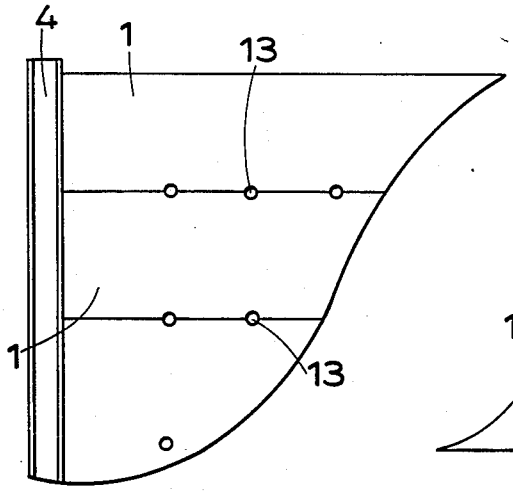
FIG. 11 is a plan of a portion of a heater similar to that of FIG. 1 but showing a modification.

All the elements illustrated above in FIGS. 3–10 may be arranged in a side-by-side parallel configuration with adjacent elements spaced from each other to define the longitudinally extending slots described above with reference to FIGS. 1 and 2. However, in the embodiment of FIG. 11, the elements 1 are clamped together with adjacent mating faces in abutment and a plurality of holes 13 are formed in the heater for drainage and air flow purposes. Conveniently notches of substantially semi-circular outline are provided at spaced intervals in the edges of the elements so that when the edges are clamped into mating engagement the notches come into registry to define the holes 13.

In the construction described above the heater is formed in its upper surface with a series of regular convolutions comprising corrugations defined by and between the adjacent individual heater elements with the slots 2 or holes 13 positioned in the re-entrant portions of the corrugations.

Figure 12:
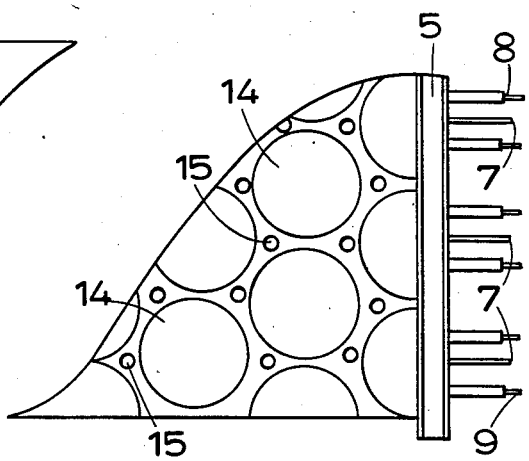
FIG. 12 is a plan of a portion of another heater.

In the construction of FIG. 12 the convolutions are in the form of convexities. As illustrated in heater comprises a panel in the form of a corrosion resistant case of similar construction to the elements of FIGS. 1–11 and of which the top wall is formed with a plurality of regularly arranged spaced discrete domes of convex outline 14, and drain and air circulation holes 15 which traverse the panel are arranged between adjacent domes 14 at their re-entrant ends or roots.

In this construction the panel is of unitary construction with the thermocouple 7 and the lengths 8 and 9 of resistance wire extending longitudinally between its opposite ends. As in the heater elements described above, the thermocouple 7 and the wire 8 and 9 are embedded in cast mineral cement and the remainder of the space in the panel is filled by a filler of glass fibre or ceramic wool insulation.

Figure 13:
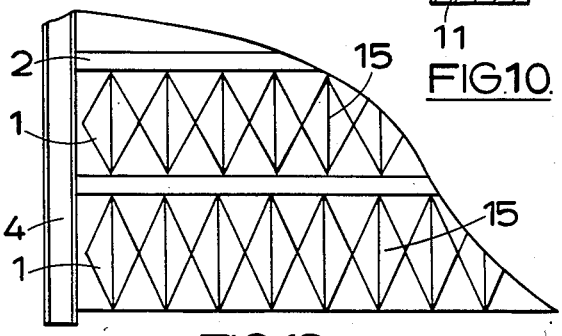
FIG. 13 is a plan of a portion of yet another heater.

In the heater illustrated in FIG. 13 of the drawings in which a plurality of individual elements 1 are clamped together in a spaced parallel, side-by-side, relationship the top wall of the case of each element has a configuration of individual, discrete, regions 15, each of pyramidal outline.

I claim:

1. An electrical resistance heater comprising a planar structure having at least one heating element comprising a casing containing resistance heating wire embedded in a matrix of a material of good thermal conductivity and having an upper radiating surface which is provided with a series of convolutions with lowermost portions which communicate with openings extending through said heater between said convolutions.

2. A heater as claimed in claim 1, wherein said resistance wire is insulated within a metal sheath by finely divided electrically non-conductive filling material.

3. A heater as claimed in claim 2, wherein said material is mineral powder.

4. A heater as claimed in claim 1, wherein said matrix comprises cast mineral cement.

5. A heater as claimed in claim 1, wherein said casing is of metal.

6. A heater as claimed in claim 1, wherein a plurality of said elements are provided, and said convolutions comprise corrugations, said corrugations being provided by at least one sloping upper surface on each of the said individual elements.

7. A heater as claimed in claim 1, wherein said convolutions comprise convexities.

8. A heater as claimed in claim 1, wherein said convolutions are pyramidal in configuration.

9. A heater as claimed in claim 1, comprising a plurality of individual heater elements wherein said openings comprise holes defined between the complementary faces of adjacent said elements.

10. A heater as claimed in claim 1, wherein said heater comprises a panel of unitary construction comprising a casing having an upper wall, and said upper wall is provided with a series of regular convolutions.

11. A heater as claimed in claim 10, wherein said convolutions comprise a plurality of regularly arranged spaced discrete domes of convex outline, and drain and air circulation holes are arranged between adjacent said domes at re-entrant ends of said domes.

12. A heater as claimed in claim 1, wherein said casing includes a zone disposed below said matrix and said zone is filled with a heat insulating material.

13. A heater as claimed in claim 1 including a thermocouple.

14. A heater as claimed in claim 13, wherein said thermo-couple is placed in close proximity to said casing.

15. A heater as claimed in claim 13, wherein said thermo-couple is disposed within a pocket, and said pocket is in contact with sheathing in which said heating wire is disposed.

* * * * *